US006748925B1

(12) United States Patent
De Vulpillieres et al.

(10) Patent No.: US 6,748,925 B1
(45) Date of Patent: Jun. 15, 2004

(54) INJECTOR AND FUEL RAIL ASSEMBLY FOR INSTALLATION ON AN INTEGRATED FUEL RAIL

(75) Inventors: Didier J. De Vulpillieres, Williamsburg, VA (US); Jack R. Lorraine, Newport News, VA (US); William Peterson, Smithfield, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 67 days.

(21) Appl. No.: 09/699,726

(22) Filed: Oct. 30, 2000

(51) Int. Cl.[7] ..... F02M 55/02
(52) U.S. Cl. ..... 123/470; 123/456
(58) Field of Search ..... 123/470, 469, 123/468, 456, 509

(56) References Cited

U.S. PATENT DOCUMENTS

| | | | | |
|---|---|---|---|---|
| 4,307,693 A | | 12/1981 | Glöckler et al. | |
| 4,823,754 A | * | 4/1989 | Minamoto et al. | 123/470 |
| 4,909,221 A | | 3/1990 | Heuser | 123/470 |
| 5,040,512 A | * | 8/1991 | Twilton | 123/470 |
| 5,044,340 A | | 9/1991 | Robnett | 123/470 |
| 5,136,999 A | * | 8/1992 | Bassler et al. | 123/470 |
| 5,394,850 A | | 3/1995 | Murphy et al. | 123/470 |
| 5,465,699 A | | 11/1995 | Voigt | 123/470 |
| 5,657,733 A | | 8/1997 | Dozier et al. | 123/470 |
| 5,680,845 A | | 10/1997 | Peng | |
| 5,682,859 A | | 11/1997 | Wakeman | 123/470 |
| 5,970,953 A | * | 10/1999 | Lorraine et al. | 123/470 |
| 6,053,149 A | * | 4/2000 | Lorraine | 123/470 |
| 6,148,797 A | * | 11/2000 | Gmelin | 123/456 |
| 6,178,950 B1 | * | 1/2001 | Stockner et al. | 123/470 |

FOREIGN PATENT DOCUMENTS

EP 0 430 525 A2 6/1991

* cited by examiner

*Primary Examiner*—Carl S. Miller

(57) ABSTRACT

A fuel assembly is provided. The fuel assembly includes a fuel supply conduit, an air intake manifold, a fuel injector, and a spacer. The air intake manifold is disposed a predetermined distance from the fuel supply conduit. The fuel injector has a first end disposed in the fuel supply conduit and a second end disposed in the air intake manifold. The fuel injector has a length greater than the predetermined distance. The spacer is disposed about a portion of the fuel injector such that the spacer retains the first end of the fuel injector in the fuel supply conduit and the second end of the fuel injector in the air intake manifold. Methods of installing and removing the fuel injector into and from the fuel supply conduit and the air intake manifold are also provided.

17 Claims, 6 Drawing Sheets

INJECTOR AND FUEL RAIL ASSEMBLY FOR INSTALLATION ON AN INTEGRATED FUEL RAIL

FIELD OF THE INVENTION

The present invention relates to fuel assemblies in which a fuel rail and an air manifold are preassembled a predetermined distance apart from each other, and then fuel injectors are installed in the fuel rail and the air manifold.

BACKGROUND OF THE INVENTION

In an internal combustion engine, fuel injectors are used to provide precisely metered amounts of fuel to a combustion air supply for combustion. For a typical top feed fuel injector, the fuel is provided to the fuel injector from a fuel rail connected to one end of the injector, typically called the fuel inlet. The fuel injector meters the fuel from a distal end of the injector, typically called the injector tip. The fuel is metered into an air intake manifold, where the fuel mixes with the combustion air prior to its introduction into the combustion chamber.

In a typical top feed injector fuel rail installation, the fuel rail engages the fuel inlet of the fuel injector in a fuel cup, which surrounds the inlet tube of the fuel injector. The fuel cup/fuel inlet interface is made leak-proof through the use of a seal, typically an o-ring installed on the injector. A retaining device, such as a clip, secures each injector in place in its respective rail cup.

In some installations, a need exists for the injector spray to be precisely positioned in reference to the engine components. This is usually done in the installation by incorporating an anti-rotating device that can be part of the function of the retaining device.

At the discharge end of the injector, the injector tip is inserted into the air intake manifold by engaging each fuel injector into a corresponding intake air manifold pocket. The pocket/injector tip interface is typically sealed with a seal, such as an o-ring mounted on the fuel injector. Once the assembly is installed, the rail is securely connected to the air intake manifold, such as by welding, bolting, or other known connection method. The fuel injectors are held between the fuel rail and the air intake manifold, with little or no axial play for the fuel injector.

An integrated fuel rail/air intake manifold, where the fuel rail is connected to the air intake manifold by molding the fuel rail with the air intake manifold, or by welding, bolting, or otherwise connecting the fuel rail to the air intake manifold, requires the connection of the fuel rail and air intake manifold prior to the insertion of the fuel injectors. Such a design has several advantages, including a lower cost of an integrated fuel rail/air intake manifold as compared to two separate components, a better mounting location of the fuel rail on the air intake manifold for better protection from impact, and a lower installation cost as compared to installing separate components.

However, to provide such an integrated fuel rail/air intake manifold assembly, the distance between the injector cup on the fuel rail and the air intake manifold pocket is shorter than the length of the fuel injector. It would be beneficial to provide a configuration of an integrated fuel rail/air intake manifold assembly with fuel injectors which enables installation of the fuel injectors into the assembly.

BRIEF SUMMARY OF THE PREFERRED EMBODIMENTS

Briefly, the present invention provides a fuel assembly comprising a fuel supply conduit, an air intake manifold, a fuel injector, and a spacer. The air intake manifold is disposed a predetermined distance from the fuel supply conduit. The fuel injector has a first end disposed in the fuel supply conduit and a second end disposed in the air intake manifold. The fuel injector has a length greater than the predetermined distance. The spacer is disposed about a portion of the fuel injector such that the spacer retains the first end of the fuel injector in the fuel supply conduit and the second end of the fuel injector in the air intake manifold.

A clip for connecting a fuel injector to one of a fuel cup and an air intake manifold is also provided. The clip comprises a generally C-shaped body portion having a first body end, a second body end biased toward the first end, and a longitudinal axis extending therethrough. The clip also comprises a generally C-shaped upper sleeve extending generally perpendicular to the longitudinal axis. The upper sleeve has a first upper sleeve end and a second upper sleeve end biased toward the first upper sleeve end. An upper connector connects the upper sleeve to the body portion. The clip further comprises a generally C-shaped lower sleeve extending generally parallel to the upper sleeve. The lower sleeve has a first lower sleeve end and a second lower sleeve end biased toward the first lower sleeve end. A lower connector connects the lower sleeve to a distal end of the body portion.

A method of installing a fuel injector into a fuel supply conduit and an air intake manifold is also provided. The fuel supply conduit is disposed along an axis a predetermined distance from the air intake manifold. The method comprises inserting a first end of the fuel injector into one of the fuel supply conduit and the air intake manifold at an angle oblique to the longitudinal axis; displacing the injector toward the one of the fuel supply conduit and the air intake manifold until a second end of the fuel injector clears the other of the fuel supply conduit and the air intake manifold; pivoting the fuel injector about the first end until the fuel injector is aligned with the longitudinal axis; and displacing the injector toward the other of the fuel supply conduit and the air intake manifold until the second end of the fuel injector engages the other of the fuel supply conduit and the air intake manifold.

Also, a method of removing a fuel injector from a fuel supply conduit and an air intake manifold is provided. The fuel supply conduit is disposed along an axis a predetermined distance from the air intake manifold. The fuel injector has a first end engaged with one of the fuel supply conduit and the air intake manifold and has a second end engaged with the other of the fuel supply conduit and the air intake manifold. The method comprises displacing the fuel injector along the axis such that the first end of the fuel injector is disengaged from one of the fuel supply conduit and the air intake manifold; pivoting the fuel injector about the second end such that the first end clears the one of the fuel supply conduit and the air intake manifold; displacing the fuel injector generally along the axis such that the second end of the fuel injector is disengaged from the other of the fuel supply conduit and the air intake manifold; and removing the second end from the other of the fuel supply conduit and the air intake manifold.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE PRESENT INVENTION

Figure 1:
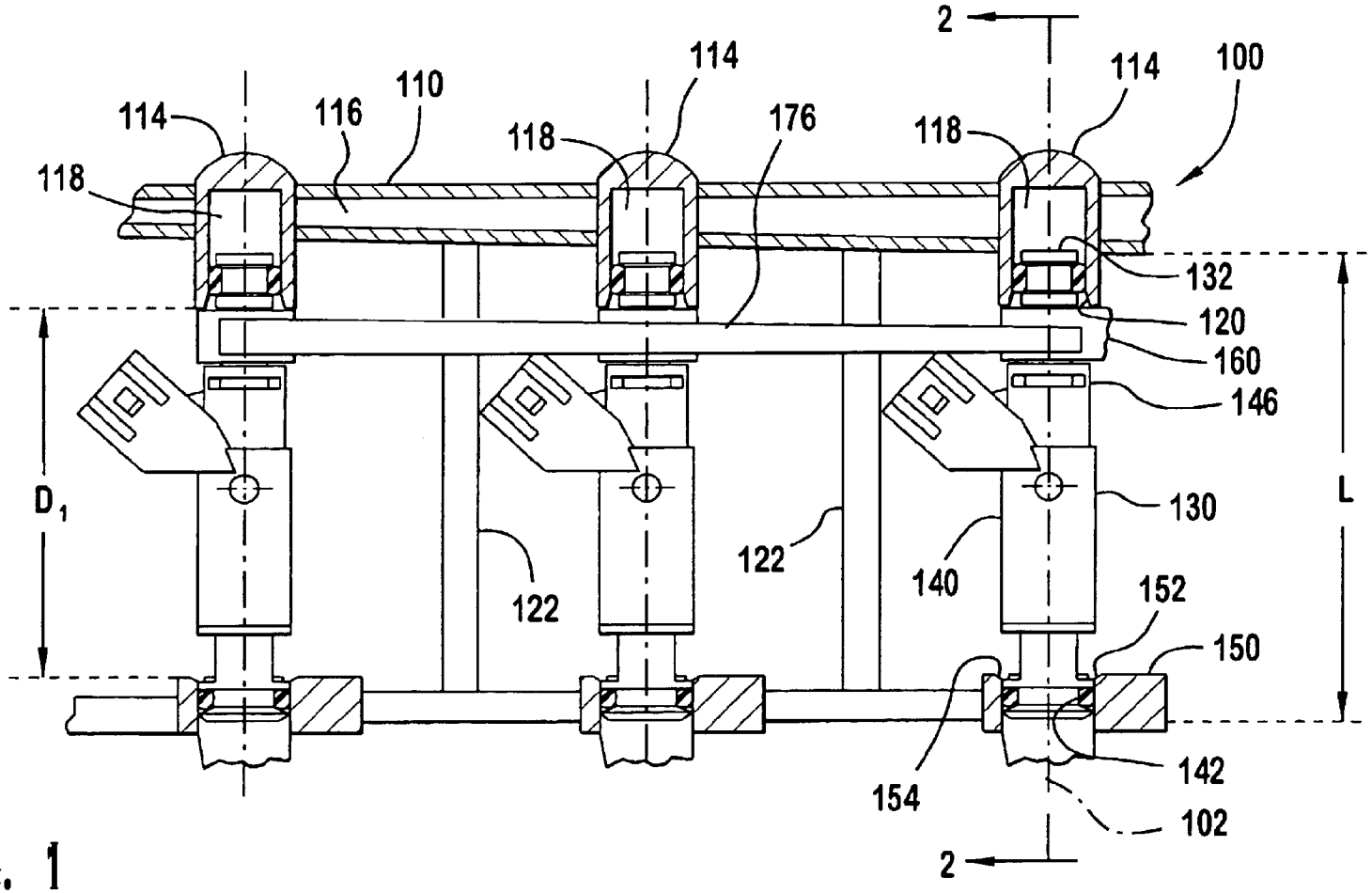
FIG. 1 is a side profile view, partially in section, of a fuel supply assembly according to the present invention.

A first preferred embodiment of a fuel supply assembly 100 is shown in FIG. 1. the assembly 100 includes a fuel supply conduit 110, a plurality of fuel injectors 130, and an air intake manifold 150, as well as a longitudinal axis 102 extending from the fuel supply conduit 110, through the fuel injector 130, and to the air intake manifold 150. As used herein, like numbers indicate like elements throughout.

Figures 2, 10:
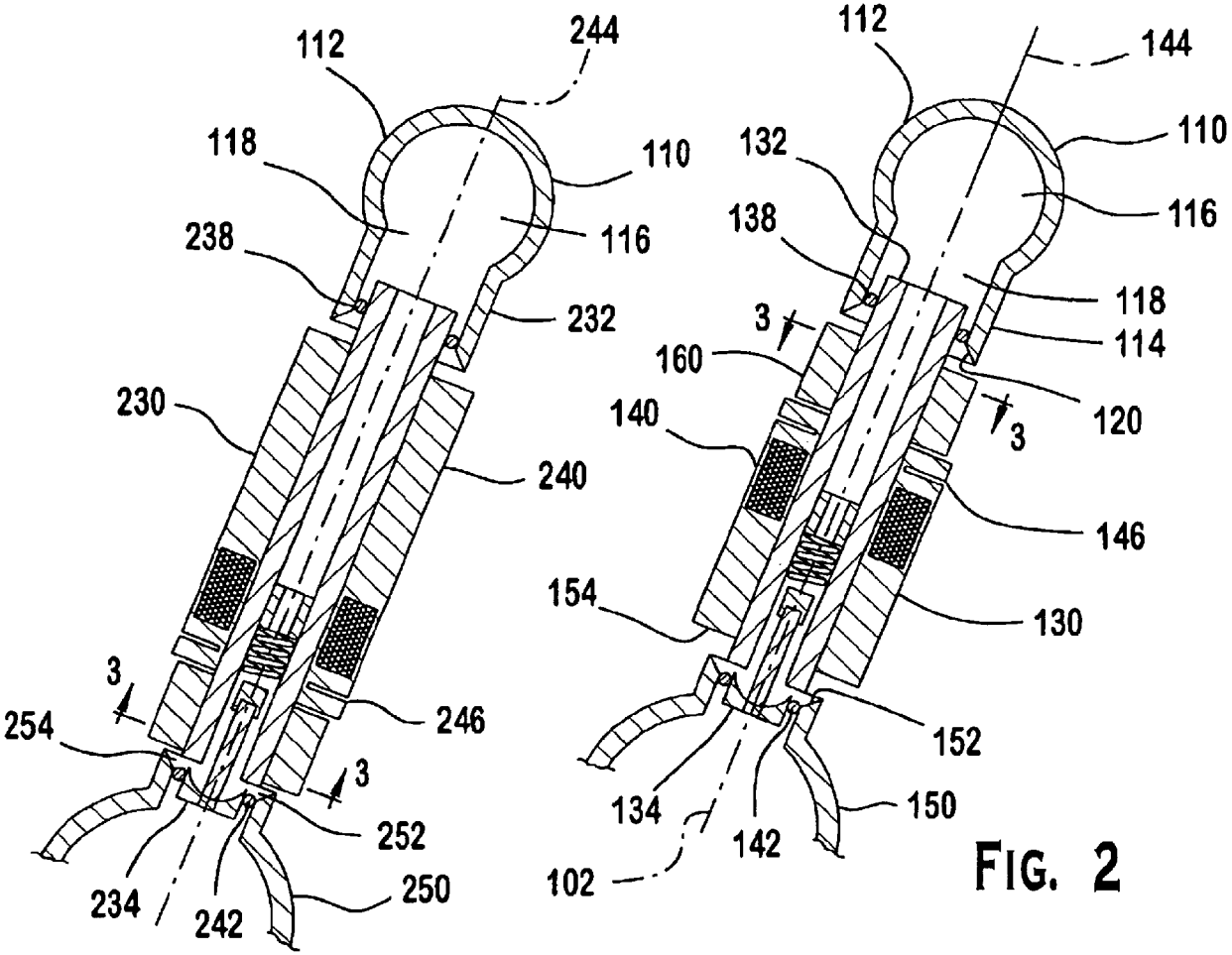
FIG. 2 is a side profile view, in section, of a first embodiment of the fuel rail assembly according to the present invention.
FIG. 10 is a side view, in section, of a second embodiment of the fuel rail assembly according to the present invention.

The fuel supply conduit 110 includes a fuel rail 112 and a plurality of fuel cups 114 which extend from the fuel rail 112, with one fuel cup 114 for each fuel injector 130 mounted to the fuel rail 112. For purposes of this disclosure, only one fuel cup 114 and a corresponding fuel injector 130 will be described. As shown in FIG. 2, the fuel rail 112 includes a fuel channel 116 through which fuel flows from a fuel supply (not shown) to the fuel cup 114. The fuel cup 114 includes a cup channel 118 which is in fluid communication with the fuel channel 116. Preferably, the cup channel 118 is relatively deep to accept the fuel injector 130. Also preferably, the fuel cup 114 include a beveled end surface 120 at an open end of the fuel cup 114.

A rail support 122 extends from the fuel rail 112 to the air intake manifold 150, fixedly connecting the fuel rail 110 to the air intake manifold 150, and disposing the air intake manifold 150 a predetermined distance $D_1$ from the fuel cup 114.

The air intake manifold 150 includes a plurality of manifold pockets 152. Preferably, each manifold pocket 152 includes a beveled end surface 154 at an open end of the manifold pocket 152.

The fuel injector 130 has a first end 132 disposed in the fuel cup channel 118 and a second end 134 disposed in the manifold pocket 152. The first end 132 is comprised of an elongated inlet tube 136, shown in the sectional view of FIG. 2. A first sealing o-ring 138 is disposed at and retained by the end of the inlet tube 136. A preferably plastic overmold 140 cinctures the inlet tube 136 at a distance from the o-ring 138, providing a relatively long length of the inlet tube 136 between the o-ring 138 and the overmold 140.

A second sealing o-ring 142 is disposed at and retained by the second end 134 of the fuel injector 130. A longitudinal axis 144, which is preferably co-linear with the longitudinal axis 102 of the assembly 100, extends through the fuel injector 130 from the first end 132 to the second end 134. The fuel injector 130 has a length L which is greater than the distance $D_1$. The length L is generally measured from the center of the first o-ring 138 and the second o-ring 142. For an injector 130 that is 60.4 millimeters long, the distance $D_1$ can be approximately ten percent shorter, or approximately 54.36 millimeters between the intake manifold 150 and the fuel cup 114.

Figure 3:
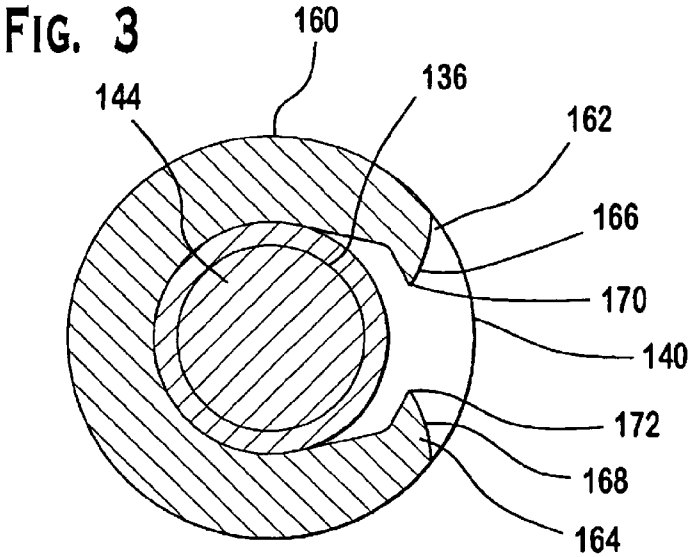
FIG. 3 is a sectional view of the fuel injector and clip taken along line 3—3 of FIG. 2.

A generally C-shaped spacer 160 is removably disposed about the inlet tube 136 between the first o-ring 138 and the overmold 140. As seen in FIG. 3, the spacer 160 includes generally opposing free ends 162, 164. Each free end 162, 164 includes a beveled face 166, 168 respectively, which provides a biasing surface for the inlet tube 136 to separate the free ends 162, 164 as the spacer 160 is inserted onto the inlet tube 136. Each free end 162, 164 also includes a barb 170, 172, respectively which assist in retaining the spacer 160 on the inlet tube 136 once the spacer 160 is installed on the inlet tube 136. Preferably, the spacer 160 is constructed from a polymer, a spring metal or some other suitable resilient material which allows the free ends 162, 164 to separate from each other as the spacer 160 is inserted over the inlet tube 136, but to return toward the original position after the barbs 170, 172 snap over the inlet tube 136. The barbs 170, 172 prevent the spacer 160 from slipping off the inlet tubes 136. When installed on the inlet tube 136, the spacer 160 retains the first end 132 of the fuel injector 130 in the fuel cup 114, and the spacer 160 also retains the second end 134 of the fuel injector 130 in the manifold pocket 152.

Referring back to FIG. 1, a plurality of spacers 160 can be connected together by a spacer bar 176 to provide a spacer function for a plurality of fuel injectors 130, in this case, three fuel injectors 130.

Figure 4:
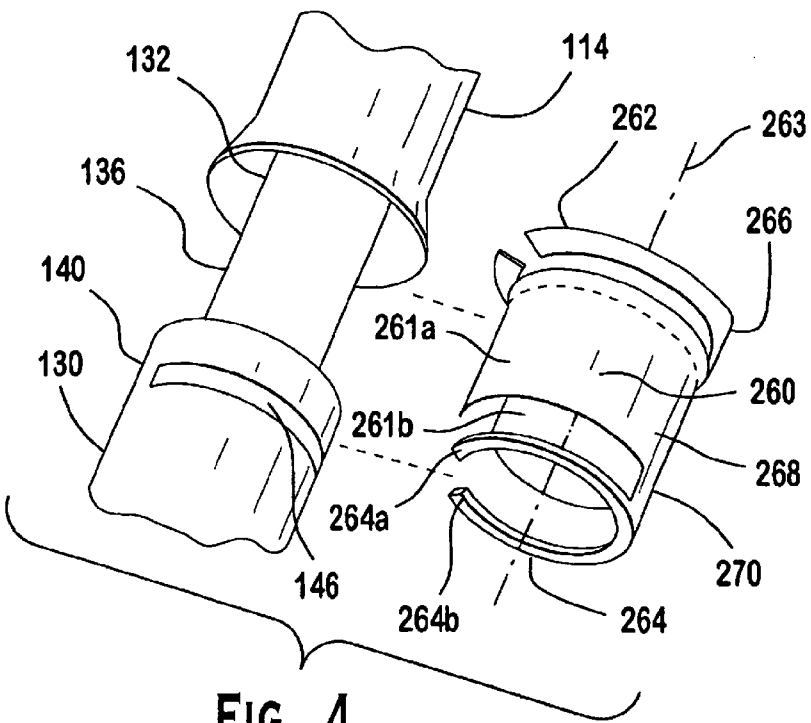
FIG. 4 is a perspective view of a second embodiment of the clip being installed on the fuel injector.
Figure 4A:
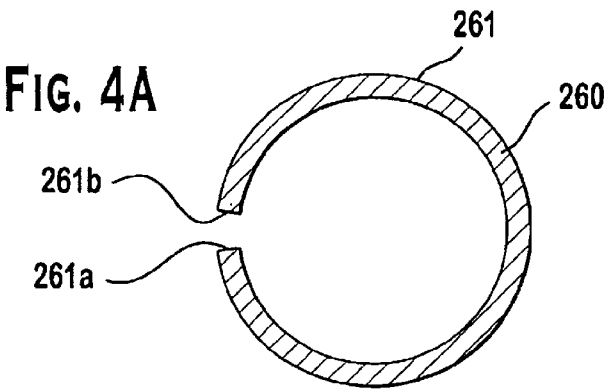
FIG. 4*a* sectional view of the clip taken along line 4*a*–4*a* of FIG. 4.

An alternate embodiment of a clip or spacer 260 with the fuel cup 114 and the fuel injector 130 is shown in perspective view in FIG. 4. A sectional view of the spacer 260 is shown in FIG. 4*a*. The spacer 260 has a generally C-shaped body portion 261 having a first end 261*a*, a second end 261*b* biased toward the first end 261*a*, and a longitudinal axis 263 extending therethrough. The spacer 260 also includes a generally C-shaped upper sleeve 262 and a generally C-shaped lower sleeve 264 which both extend generally perpendicular to the longitudinal axis 263. The upper sleeve 264 has a first upper sleeve end 264*a* and a second upper sleeve end 264*b* biased toward the first upper sleeve end 264*a*. A first connector member 266 connects the upper sleeve 262 to the body portion 261 of the spacer 260, leaving a space between the upper sleeve 262 and the body portion 261. The lower sleeve 264 has a first lower sleeve end 264*a* and a second lower sleeve end 264*b* biased toward the first lower sleeve end 264*a*. A second connector member 270 connects the lower sleeve 264 to the body portion 261 of the spacer 260, distal from the upper sleeve 262, leaving a space between the lower sleeve 264 and the body portion 261.

The body portion 261 engages the inlet tube 136 in a manner similar to the engagement of the spacer 160 with the inlet tube 136 as described above. The first connector member 262 fits over and engages the bottom end of the fuel cup 114. The second connector member 264 fits into a slot 146 in the overmold 140. The second connector member 264 engages and retains the inlet tube 136 through the slot 146 in a manner similar to the engagement of the body portion 261 with the inlet tube 136. With the spacer 260, the spacer 260 is fixedly connected to the fuel cup 114 and the fuel injector 130.

Preferably, the spacer 260 is constructed from a spring metal so that when the first connector member 262 engages the fuel cup 114, the legs of the connector member 262 sufficiently engage the fuel cup 114 to prevent rotation of the spacer 260, and subsequently the fuel injector 130, with respect to the fuel cup 114.

Figures 5, 6, 7, 8, 9:
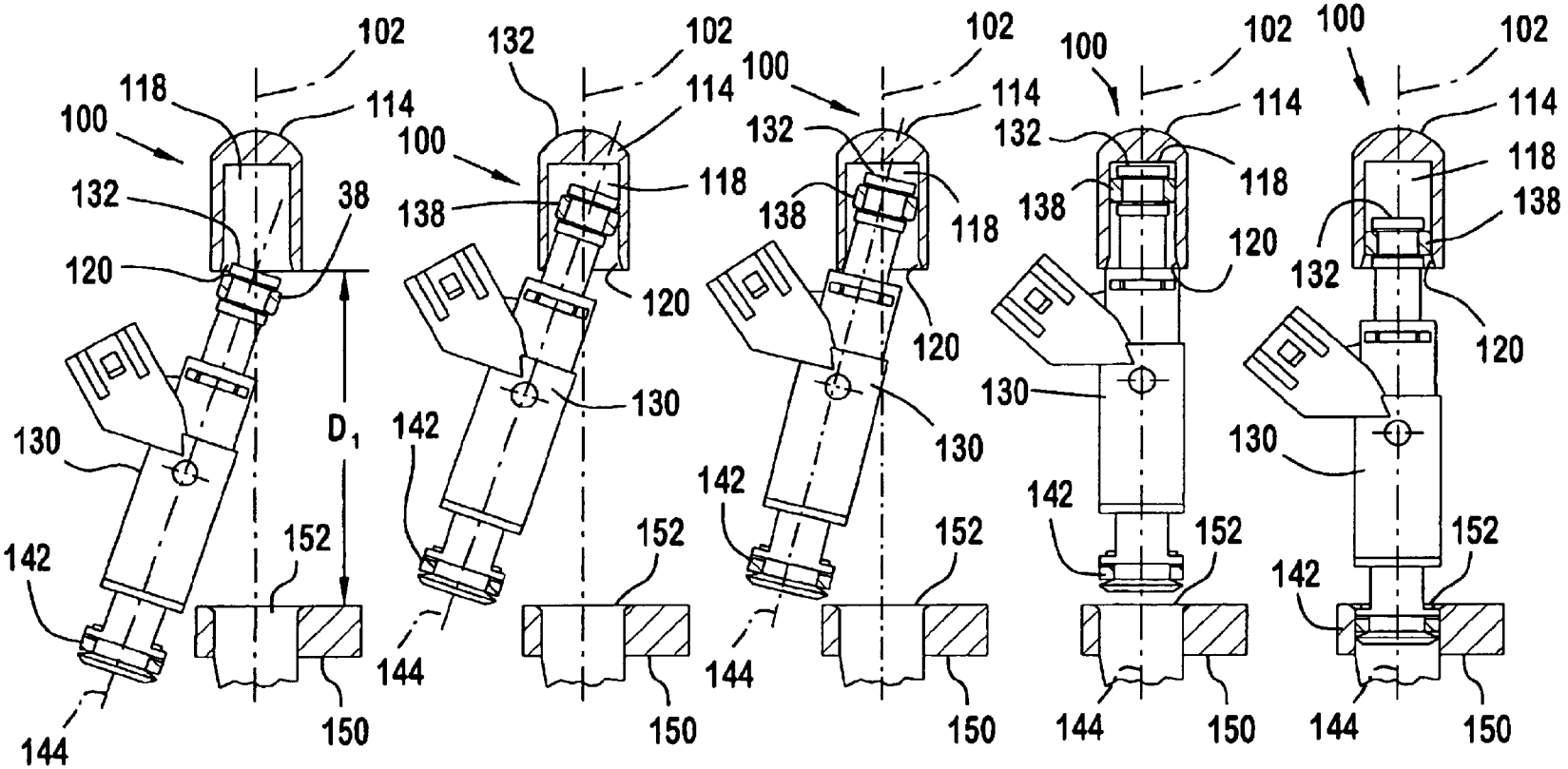
FIG. 5 is a side profile view of a first fuel injector being inserted into a fuel rail.
FIG. 6 is a side view of the first fuel injector being further inserted into the fuel rail.
FIG. 7 is a side view of the first fuel injector being fully inserted into the fuel rail.
FIG. 8 is a side view of the first fuel injector being inserted into an air manifold.
FIG. 9 is a side view of the first fuel injector being further inserted into the air manifold.

Installation of the fuel injector 130 into the assembly 100 is graphically depicted in FIGS. 5–9 as follows. The fuel conduit 110 is fixedly located the predetermined distance $D_1$ from the air intake manifold 150. As shown in FIGS. 5–6, the first end 132 of the fuel injector 130 is inserted into the fuel cup channel 118 at an angle oblique to the longitudinal axis 102 of the assembly 100. The beveled end surface 120 provides a lead in for the first end 132 of the fuel injector 130. The fuel injector 130 is then pushed up into the cup 114 until the second end 134 of the injector 130 clears the top of the manifold pocket 152 (FIG. 7). The injector 130 is then pivoted about the first end 132 until the longitudinal axis 144 of the fuel injector 130 is generally aligned with the longitudinal axis 102 of the assembly 100, shown in FIG. 8. The fuel injector 130 is then pulled downward so that the second end 134 of the fuel injector 130 is inserted into the manifold pocket 152, shown in FIG. 9. The beveled end surface 154 provides a lead in for the second end 134 of the fuel injector 130. The o-ring 138 seals the connection between the fuel cup 114 and the fuel injector 130, and the o-ring 142 seals the connection between the fuel injector 130 and the air intake manifold 150.

The spacer 160 is then inserted over the inlet tube 136 so that the first end 132 of the fuel injector 130 is retained in the fuel cup 114 and the second end 134 of the fuel injector 130 is retained in the manifold pocket 152. The installed spacer 160 is shown in FIG. 2. If the spacer 260 is used, the spacer 260 also engages the fuel cup 114, connecting the fuel cup 114 to the fuel injector 130. Installation of the spacer 260 is shown in FIG. 4.

With the assembly 100 of the present invention, the fuel injector 130 can be removed from the fuel conduit 110 and the air intake manifold 150 for desired reasons, such as for maintenance and/or replacement. Removal of the fuel injector 130 from the assembly 100 is shown in reverse order of FIGS. 5–9. First, the spacer 160, 260 is removed from the fuel injector 130, shown having already been removed in FIG. 9. Then, the fuel injector 130 is displaced upward along the longitudinal axis 102 until the second end 134 of the fuel injector 130 is disengaged from the air intake manifold 150, shown in FIG. 3. The fuel injector 130 is then pivoted about the first end 132 until the second end 134 clears the air intake manifold 150, shown in FIG. 7. The first end 132 of the fuel injector 130 is then displaced generally along the longitudinal axis 102 until the first end 132 is disengaged from the fuel cup 114, shown in FIGS. 6 and 5. The first end 132 of the fuel injector 130 is then removed from the fuel cup 114.

A second embodiment of an assembly 200 is shown in FIGS. 10–15. Similar elements of the second embodiment use the same last two digits as their counterpart elements of the first embodiment, but use the first digit "2" instead of "1". In the assembly 200, a second end 234 of a fuel injector 230 beyond the overmold 240 is longer than the second end 134 of the fuel injector 130 of the first embodiment. A slot 246 in the overmold 240 for the spacer 260 is located proximate the downstream end 234. Additionally, the manifold pocket 252 in the air intake manifold 250 is deeper, to allow installation of the fuel injector 230, as will be discussed. In the second embodiment, either of the spacers 160, 260 are inserted over the second end 234 between the overmold 240 and the air intake manifold 250, as shown in FIG. 10. The spacer 260 engages the slot 246 in the overmold 240, rotationally securing the spacer 260 to the fuel injector 230.

Figure 16:
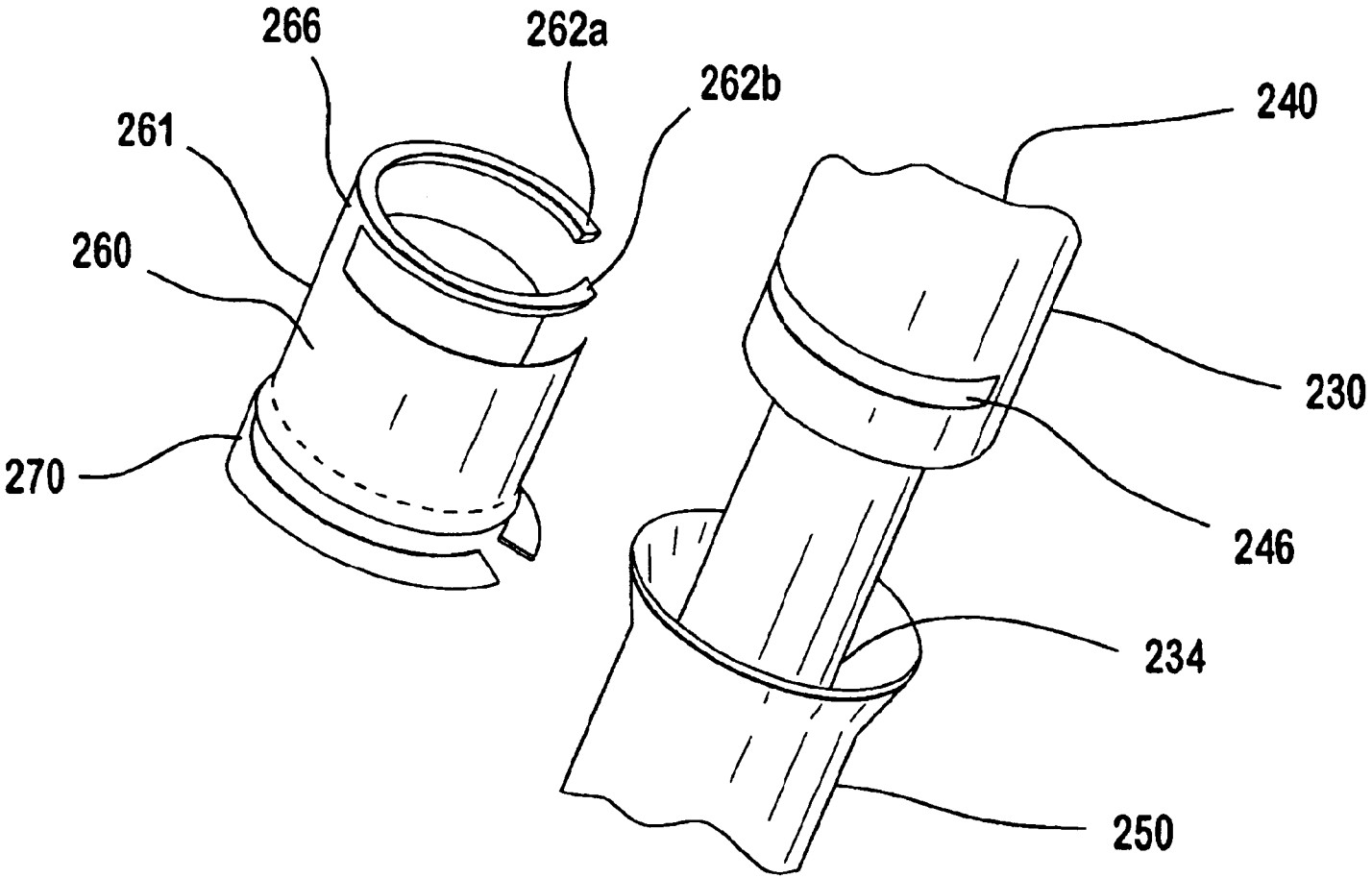
FIG. 16 is a perspective view of a second embodiment of the clip being installed on the second fuel injector.

As described above, the spacer 260 is preferably constructed from a spring metal so that when the first connector member 262 engages the air intake manifold 250, the legs of the connector member 262 sufficiently engage the air intake manifold 250 to prevent rotation of the spacer 260, and subsequently the fuel injector 230, with respect to the air intake manifold 250. Engagement of the spacer 260 with the assembly 200 is shown in FIG. 16.

Installation of the fuel injector 230 into the assembly 200 is similar to the installation of the fuel injector 130 into the assembly 100, with the exception that the second end 234 of the fuel injector is installed into the air intake manifold 250 before the first end 232 of the fuel injector 230 is installed into the fuel cup 214.

Figures 11, 12, 13, 14, 15:
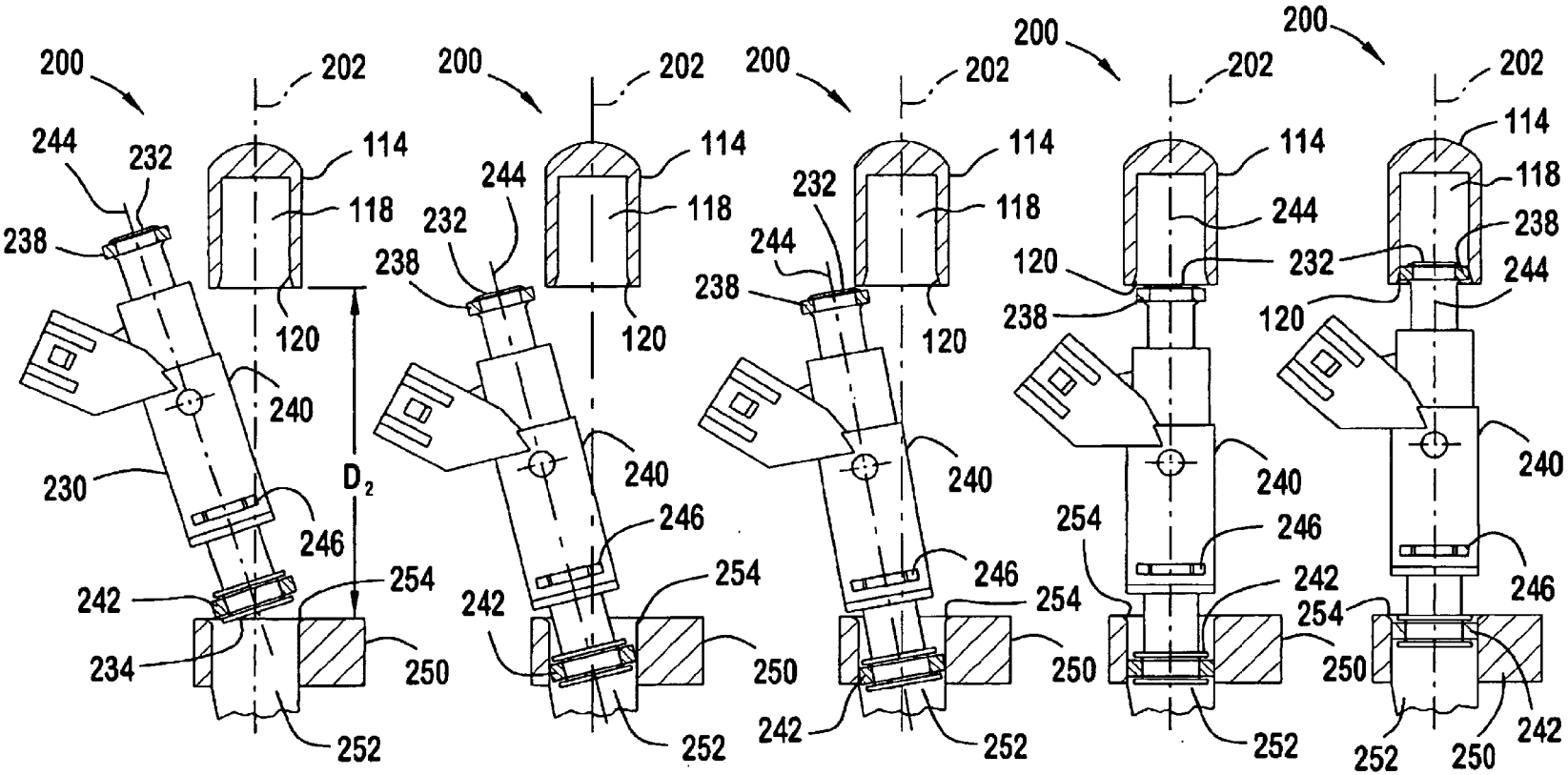
FIG. 11 is a side profile view of a second fuel injector being inserted into the air manifold.
FIG. 12 is a side view of the second fuel injector being further inserted into the air manifold.
FIG. 13 is a side view of the second fuel injector being fully inserted into the air manifold.
FIG. 14 is a side view of the second fuel injector being inserted into the fuel rail.
FIG. 15 is a side view of the second fuel injector being further inserted into the fuel rail.

The fuel conduit 210 is fixedly located the predetermined distance $D_2$ from the air intake manifold 250. As shown in FIGS. 11–12, the second end 234 of the fuel injector 230 is inserted into the manifold pocket 252 at an angle oblique to the longitudinal axis 202 of the assembly 200. The beveled end surface 254 of the manifold pocket 252 provides a lead in for the second end 234 of the fuel injector 230. The fuel injector 230 is then pushed down into the manifold pocket 252 until the first end 232 of the injector 230 clears the bottom of the fuel cup (FIG. 13). The injector 230 is then pivoted about the second end 234 until the longitudinal axis 244 of the fuel injector 230 is generally aligned with the longitudinal axis 202 of the assembly 200, shown in FIG. 9. The fuel injector 230 is then pushed upward so that the first end 232 of the fuel injector 230 is inserted into the fuel cup 114, shown in FIG. 15. The beveled end surface 120 of the fuel cup 114 provides a lead in for the first end 232 of the fuel injector 230. The first o-ring 238 seals the connection between the fuel cup 214 and the fuel injector 230, and the second o-ring 242 seals the connection between the fuel injector 230 and the air intake manifold 250.

The spacer 160 is then inserted over the second end 234 so that the first end 232 of the fuel injector 230 is retained in the fuel cup 214 and the second end 234 of the fuel injector 230 is retained in the manifold pocket 252. The inserted spacer 160 is shown in FIG. 10. If the spacer 260 is used, the spacer 260 also engages the manifold pocket 252, connecting the manifold pocket 252 to the fuel injector 230. Insertion of the spacer 260 is shown in FIG. 16.

Similar to the assembly 100, with the assembly 200 of the present invention, the fuel injector 230 can be removed from the fuel conduit 210 and the air intake manifold 250 for desired reasons, such as for maintenance and/or replacement. Removal of the fuel injector 230 from the assembly 200 is shown in reverse order of FIGS. 11–15. First, the spacer 160, 260 is removed from the fuel injector 230, shown having already been removed in FIG. 15. Then, the fuel injector 230 is displaced downward along the longitudinal axis 202 until the first end 232 of the fuel injector 230 is disengaged from the fuel cup 214, shown in FIG. 14. The fuel injector 230 is then pivoted about the second end 234 until the first end 232 clears the fuel cup 214, shown in FIG. 13. The second end 234 of the fuel injector 230 is then displaced generally along the longitudinal axis 202 until the second end 232 is disengaged from the manifold pocket 252, shown in FIGS. 12 and 11. The second end 234 of the fuel injector 230 is then removed from the manifold pocket 252.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A clip for connecting a fuel injector to one of a fuel cup and an air intake manifold, the clip comprising:

a generally C-shaped body portion having a first body portion being spaced from a second body portion along a longitudinal axis to form a body surface, the body surface extending generally parallel to and about the longitudinal axis, the body surface including a first body end being disposed in a facing arrangement with a second body end, the second body end being biased toward the first body end about the longitudinal axis;

a generally C-shaped upper sleeve extending generally perpendicular to the longitudinal axis and spaced from the generally C-shaped body portion, the upper sleeve having a first upper sleeve end and a second upper sleeve end biased toward the first upper sleeve end about the longitudinal axis;

an upper connector connecting the upper sleeve to the first body portion;

a generally C-shaped lower sleeve extending generally parallel to the upper sleeve and spaced from the cylindrical shaped body portion, the lower sleeve having a first lower sleeve end and a second lower sleeve end biased toward the first lower sleeve end about the longitudinal axis; and a lower connector connecting the lower sleeve to the second body portion.

2. The clip according to claim 1, wherein the clip comprises a spring metal.

3. The clip according to claim 1, wherein the upper sleeve is adapted to engage one of the fuel injector and the one of the fuel cup and the air intake manifold, and the lower sleeve is adapted to engage the other of the fuel injector and the one of the fuel cup and the air intake manifold.

4. A method of installing a fuel injector into a fuel supply conduit and an air intake manifold, the fuel supply conduit being disposed along an axis a predetermined distance from the air intake manifold, the method comprising:

inserting a first end of the fuel injector into one of the fuel supply conduit and the air intake manifold at an angle oblique to the longitudinal axis;

displacing the injector toward the one of the fuel supply conduit and the air intake manifold until a second end of the fuel injector clears the other of the fuel supply conduit and the air intake manifold;

pivoting the fuel injector about the first end until the fuel injector is aligned with the longitudinal axis;

displacing the injector toward the other of the fuel supply conduit and the air intake manifold until the second end of the fuel injector engages the other of the fuel supply conduit and the air intake manifold; and after displacing the injector, inserting a spacer over a portion of the fuel injector and over a portion of one of the fuel supply conduit and intake manifold, the spacer retaining one end of the fuel injector at least partially in the fuel supply conduit and another end of the fuel injector at least partially in the air intake manifold.

5. The method according to claim 4, wherein inserting the spacer comprises connecting the spacer to at least one of the fuel supply conduit and the air intake manifold.

6. The method according to claim 4, wherein inserting the first end of the injector comprises inserting the injector into the fuel supply conduit.

7. The method according to claim 4, wherein inserting the first end of the injector comprises inserting the injector into the air intake manifold.

8. The method according to claim 4, further comprising, prior to inserting the first end of the injector, fixedly connecting the fuel supply conduit to the air intake manifold.

9. A method of removing a fuel injector from a fuel supply conduit and an air intake manifold, the fuel supply conduit being disposed along an axis a predetermined distance from the air intake manifold, the fuel injector having a first end engaged with one of the fuel supply conduit and the air intake manifold and having a second end engaged with the other of the fuel supply conduit and the air intake manifold, the method comprising:

displacing the fuel injector along the axis such that the first end of the fuel injector is disengaged from one of the fuel supply conduit and the air intake manifold;

pivoting the fuel injector about the second end such that the first end clears the one of the fuel supply conduit and the air intake manifold;

displacing the fuel injector generally along the axis such that the second end of the fuel injector is disengaged from the other of the fuel supply conduit and the air intake manifold;

removing the second end from the other of the fuel supply conduit and the air intake manifold; and prior to displacing the fuel injector along the axis, removing a spacer from the fuel injector, the spacer adapted to surround one end of the fuel injector and to surround one of the fuel supply conduit and the air intake manifold prior to removal of the fuel injector.

10. A fuel assembly comprising:

a fuel supply conduit having a fuel rail and a fuel cup;

an air intake manifold disposed a predetermined distance from the fuel supply conduit;

a plurality of injectors, each having a first end disposed in the fuel cup and a second end disposed in the air intake manifold, each fuel injector having a length greater than the predetermined distance;

a spacer being disposed about a portion of the fuel injector and surrounding a portion of one of the fuel cup and intake manifold, the spacer retaining the first end of the fuel injector in the fuel cup and the second end of the fuel injector in the air intake manifold such that the spacer is spaced away from the fuel rail with no contact therebetween; and a spacer bar being coupled to each of the plurality of fuel injector.

11. The fuel assembly according to claim 10, wherein the predetermined distance is approximately ten percent shorter than the length of the fuel injector.

12. The fuel assembly of claim 10, wherein the spacer surrounds only a portion of the fuel injector.

13. The fuel assembly according to claim 10, wherein the fuel supply conduit is fixedly connected to the air intake manifold.

14. The fuel assembly according to claim 10, wherein the spacer is fixedly connected to at least one of the fuel supply conduit and the air intake manifold.

15. The fuel assembly according to claim 10, wherein the spacer is generally C-shaped.

16. The fuel assembly according to claim 10, wherein the spacer rotationally secures the fuel injector relative to at least one of the fuel supply conduit and the air intake manifold.

17. The fuel assembly of claim 11, wherein the predetermined distance comprises a distance of approximately 54 millimeters and wherein the length of the fuel injector comprises a length of approximately 60 millimeters.

* * * * *